US009702559B2

(12) United States Patent
Hiura

(10) Patent No.: US 9,702,559 B2
(45) Date of Patent: Jul. 11, 2017

(54) HEATER AND GLOW PLUG PROVIDED WITH SAME

(75) Inventor: Norimitsu Hiura, Kirishima (JP)

(73) Assignee: KYOCERA CORPORATION, Kyoto-Shi, Kyoto (JP)

( * ) Notice: Subject to any disclaimer, the term of this patent is extended or adjusted under 35 U.S.C. 154(b) by 1036 days.

(21) Appl. No.: 13/809,477

(22) PCT Filed: Jul. 26, 2011

(86) PCT No.: PCT/JP2011/066923
§ 371 (c)(1),
(2), (4) Date: Feb. 27, 2013

(87) PCT Pub. No.: WO2012/014872
PCT Pub. Date: Feb. 2, 2012

(65) Prior Publication Data

US 2013/0146579 A1 Jun. 13, 2013

(30) Foreign Application Priority Data

Jul. 30, 2010 (JP) ..... 2010-172133

(51) Int. Cl.

| | |
|---|---|
| ***F23Q 7/22*** | (2006.01) |
| ***H05B 3/48*** | (2006.01) |
| ***F23Q 7/00*** | (2006.01) |
| ***H05B 3/00*** | (2006.01) |

(52) U.S. Cl.
CPC ..... *F23Q 7/22* (2013.01); *F23Q 7/001* (2013.01); *H05B 3/0004* (2013.01); *H05B 3/48* (2013.01); *H05B 2203/027* (2013.01)

(58) Field of Classification Search
CPC ..... F23Q 7/001; F23Q 7/22; H05B 2203/027
USPC ..... 219/267
See application file for complete search history.

(56) References Cited

U.S. PATENT DOCUMENTS

| | | | | |
|---|---|---|---|---|
| 3,662,222 A * | 5/1972 | Ray | G01F 1/52 | 219/260 |
| 4,733,056 A * | 3/1988 | Kojima | H05B 3/283 | 219/270 |
| 4,814,581 A * | 3/1989 | Nunogaki | F23Q 7/001 | 219/270 |
| 6,204,481 B1 * | 3/2001 | Ito | H05B 3/141 | 123/145 A |

(Continued)

FOREIGN PATENT DOCUMENTS

| | | |
|---|---|---|
| EP | 1255075 A2 | 11/2002 |
| EP | 1610589 A1 | 12/2005 |

(Continued)

OTHER PUBLICATIONS

Chinese Office Action with English concise explanation, Chinese Patent Appln. No. 201180027931.5, Jul. 2, 2014, 7 pp.

*Primary Examiner* — David Angwin
*Assistant Examiner* — John J Norton
(74) *Attorney, Agent, or Firm* — Volpe and Koenig, P.C.

(57) ABSTRACT

A heater includes a resistor including a heat-generating portion, one or more leads joined to end portions of the resistor, and an insulating base body which covers the resistor and the leads, and a joining portion between the resistor and the leads includes a region where the resistor is spaced apart from the insulating base body by way of the leads over a whole circumference of the resistor when viewed in cross section of the joining portion.

12 Claims, 9 Drawing Sheets

(56) References Cited

U.S. PATENT DOCUMENTS

| | | | | |
|---|---|---|---|---|
| 6,433,311 | B1 * | 8/2002 | Teramura | F23Q 7/001 219/270 |
| 2002/0162830 | A1 | 11/2002 | Taniguchi et al. | |
| 2002/0162831 | A1 | 11/2002 | Taniguchi et al. | |
| 2005/0067406 | A1 * | 3/2005 | Rajarajan | B82Y 30/00 219/553 |
| 2005/0104496 | A1 * | 5/2005 | Ando | F23Q 7/001 313/141 |
| 2005/0252909 | A1 * | 11/2005 | Andersson | H05B 3/64 219/541 |
| 2005/0284859 | A1 | 12/2005 | Konishi | |
| 2010/0288747 | A1 | 11/2010 | Yamamoto | |

FOREIGN PATENT DOCUMENTS

| | | | | |
|---|---|---|---|---|
| JP | 2000130754 | A | * | 5/2000 |
| JP | 2002334768 | A | | 11/2002 |
| JP | 2003022889 | A | | 1/2003 |
| JP | 2006040882 | A | | 2/2006 |
| WO | 2009057597 | A1 | | 5/2009 |

* cited by examiner

HEATER AND GLOW PLUG PROVIDED WITH SAME

FIELD OF INVENTION

The present invention relates to a heater which is utilized as, for example, a heater for ignition or flame detection in a combustion-type vehicle-mounted heating device, a heater for ignition for various combustion equipment such as an oil fan heater, a heater for a glow plug of an automobile engine, a heater for various sensors such as an oxygen sensor, a heater for heating of measuring equipment, and a glow plug provided with such a heater.

BACKGROUND

A heater used in a glow plug of an automobile engine or the like is constituted of a resistor having a heat-generating portion, a lead and an insulating base body. The selection and the design of materials for these parts are made such that the resistance of the lead is smaller than the resistance of the resistor.

A joining portion between the resistor and the lead forms a shape change point or a material composition change point. Accordingly, it has been known that, for the purpose of increasing a joining area so as not to be influenced by the difference in thermal expansion due to heat-generation or cooling in use, an interface between the resistor and the lead is formed obliquely when viewed in cross section parallel to the axial direction of the lead (see Patent Literatures 1 and 2, for example).

CITATION LIST

Patent Literature

Patent Literature 1: Japanese Unexamined Patent Publication JP-A 2002-334768

Patent Literature 2: Japanese Unexamined Patent Publication JP-A 2003-22889

SUMMARY

Technical Problem

Recently, to cope with a demand for more rapid temperature elevation compared to the related art, it has become necessary to flow a large amount of electric current to a resistor at a time of starting an operation of an engine. In a heater having a shape where an interface between a resistor and a lead is formed obliquely when viewed in cross section parallel to the axial direction of the lead (a shape where a triple interface is formed by bringing a peripheral portion of an interface which becomes a boundary between the resistor and the lead into contact with an insulating base body), an electric current which flows through the lead is liable to be concentrated on one point of the triple interface at an end portion of a joining portion, thus giving rise to a drawback that stress concentrates on such a portion and generating cracks in the end portion.

The invention has been made in view of the above-mentioned drawbacks of the related art, and it is an object of the invention to provide a heater having high reliability and durability where the generation of large stress concentration on an end portion of a joining portion between a resistor and leads can be suppressed even when a large electric current flows through the resistor at the time of rapid temperature elevation or the like, and a glow plug provided with the heater.

Solution to Problem

The invention provides a heater including a resistor including a heat-generating portion, one or more leads joined to end portions of the resistor, and an insulating base body which covers the resistor and the leads, wherein a joining portion between the resistor and the leads including a region where the resistor is spaced apart from the insulating base body by way of the leads over a whole circumference of the resistor when viewed in cross section of the joining portion.

In the heater constituted mentioned above, it is preferable that a profile of the resistor in the joining portion is tapered toward a side opposite to the heat-generating portion.

Further, in the heater constituted mentioned above, it is preferable that the resistor has a folded shape, each of the leads are joined to the end portions of the resistor, respectively, and a centroid of the resistor is positioned outside a centroid of each of the leads when the joining portion is viewed in cross section perpendicular to an axial direction of each of the leads.

Further, in the heater constituted mentioned above, it is preferable that the resistor has a folded shape, each of the leads are joined to the end portions of the resistor, respectively, and an inner-side inclination angle is set steeper than an outer-side inclination angle when the joining portion is viewed in cross section parallel to the axial direction of each of the leads.

Further, in the heater constituted mentioned above, it is preferable that the resistor has a folded shape, each of the leads are joined to the end portions of the resistor, respectively, and a distal end surface of each of the leads is inclined inwardly when the joining portion is viewed in cross section parallel to the axial direction of each of the leads.

Further, in the heater constituted mentioned above, it is preferable that a profile of the resistor is formed in a curve when the joining portion is viewed in cross section perpendicular to the axial direction of each of the leads.

Further, in the heater constituted mentioned above, it is preferable that a profile of each of the leads in the joining portion is tapered toward a heat-generating portion side.

Further, the heater constituted mentioned above may be used for a glow plug, the glow plug including the heater according to any one of the constitutions mentioned above, a sheath fitting electrically connected to one lead, and a wire electrically connected to another lead.

Advantageous Effects of Invention

According to the heater of the invention, the heater includes a joining portion where the leads surround the whole circumference of the resistor and hence, an electric current which flows through the leads are dispersed so that the electric current is not concentrated on one point, that is, a triple interface provided at an end portion of the joining portion and, further, the heat dissipation from the whole circumference of the resistor to the leads is improved uniformly, thus preventing the generation of large stress concentration on the end portion of the joining portion. As a result, even when a temperature is elevated or lowered repeatedly, it is possible to suppress the generation of cracks in the end portion of the joining portion. Accordingly, the reliability and the durability of the heater are enhanced.

DETAILED DESCRIPTION OF THE PREFERRED EMBODIMENTS

Hereinafter, embodiments of a heater of the invention are explained in detail in conjunction with drawings.

Figure 1:
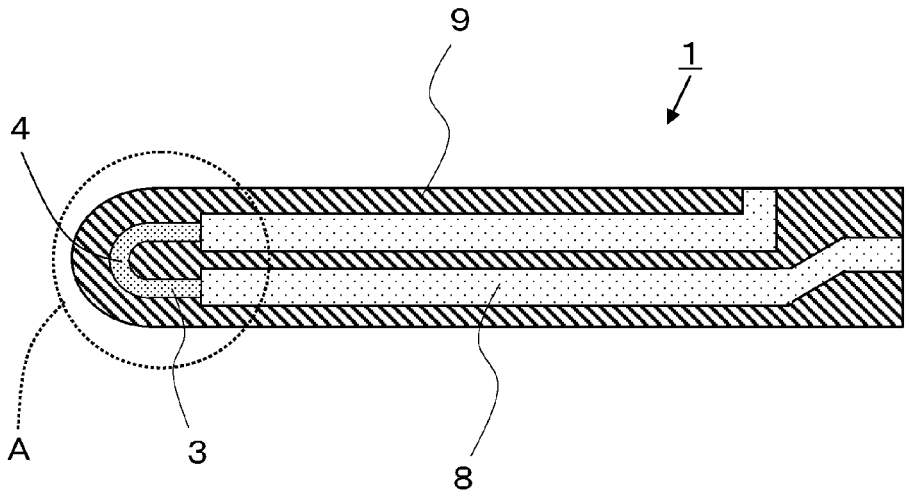
FIG. 1 is a longitudinal cross-sectional view showing one example of an embodiment of a heater according to the invention.
Figure 2:
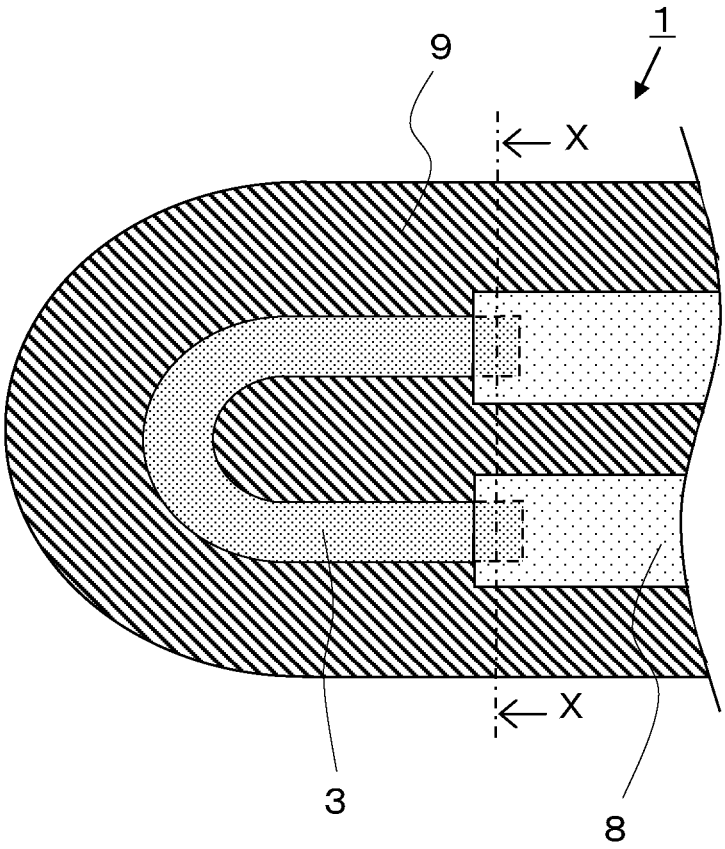
FIG. 2 is an enlarged cross-sectional view showing a region A in FIG. 1 which includes a joining portion between a resistor and leads in an enlarged manner.
Figure 3:
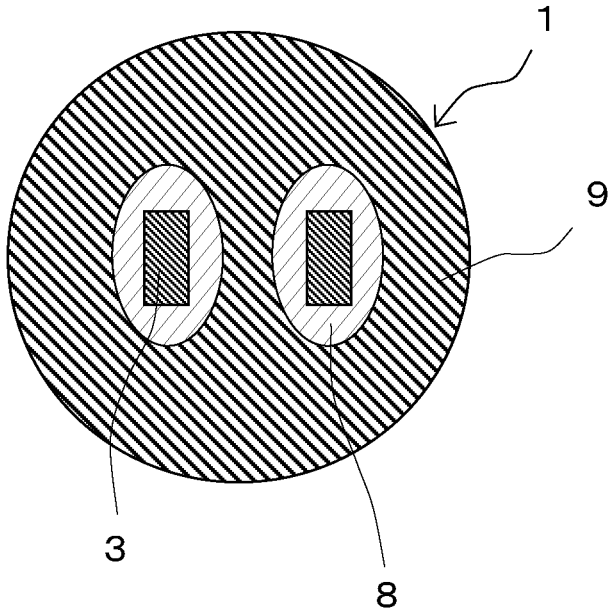
FIG. 3 is a transverse cross-sectional view taken along the line X-X in FIG. 2.

FIG. 1 is a longitudinal cross-sectional view showing one example of an embodiment of a heater according to the invention. Further, FIG. 2 is an enlarged cross-sectional view showing a region A in FIG. 1 which includes a joining portion between a resistor and leads in an enlarged manner, and FIG. 3 is a transverse cross-sectional view of a heater 1 taken along the line X-X in FIG. 2.

The heater 1 according to this embodiment includes a resistor 3 having a heat-generating portion 4, one or more leads 8 joined to end portions of the resistor 3, and an insulating base body 9 which covers the resistor 3 and the leads 8. A joining portion between the resistor 3 and the leads 8 has a region where the resistor 3 is spaced apart from the insulating base body 9 by way of the leads 8 over a whole circumference of the resistor when viewed in cross section of the joining portion.

The insulating base body 9 of the heater 1 according to this embodiment is formed into a rod shape, for example. The insulating base body 9 covers the resistor 3 and the leads 8. In other words, the resistor 3 and the leads 8 are embedded in the insulating base body 9. The insulating base body 9 is preferably made of ceramics. Because of being made of ceramics, the insulating base body 9 can withstand a higher temperature than an insulating base body made of metal and hence, it is possible to provide the heater 1 whose reliability can be further enhanced when a temperature is sharply elevated. To be more specific, as a material for forming the insulating base body 9, ceramics having an electrical insulating performance such as oxide ceramics, nitride ceramics or carbide ceramics can be named. Particularly, the insulating base body 9 is preferably made of silicon nitride ceramics. This is because silicon nitride which silicon nitride ceramics contains as a main component thereof is excellent in terms of high strength, high toughness, high insulation property and heat resistance. The silicon nitride ceramics is obtained in such a manner that, for example, 3 to 12 mass % of rare earth element oxide such as $Y_2O_3$, $Yb_2O_3$, $Er_2O_3$ which is provided as a sintering aid, 0.5 to 3 mass % of $Al_2O_3$, and 1.5 to 5 mass % of $SiO_2$ in terms of an amount of $SiO_2$ contained in a sintered body are mixed into silicon nitride which is the main component, the mixture is formed into a predetermined shape and, thereafter, the mixture is subjected to hot press baking at a temperature of 1650 to 1780° C.

Further, when the insulating base body 9 which is made of silicon nitride ceramics is used, it is preferable to mix and disperse $MoSi_2$, $WSi_2$ or the like into the insulating base body 9. In this case, it is possible to make a thermal expansion coefficient of silicon nitride ceramics which is a base material approximate a thermal expansion coefficient of the resistor 3, thus enhancing the durability of the heater 1.

The resistor 3 having the heat-generating portion 4 has a folded shape, for example, and a portion of the resistor 3 in the vicinity of an intermediate point of the folding forms the heat-generating portion 4 which generates heat most. As the resistor 3, a resistor which contains carbide, nitride, silicide or the like of W, Mo, Ti or the like as a main component can be used. When the insulating base body 9 is made of any one of the above-mentioned materials, from a viewpoint that the difference in a thermal expansion coefficient between the resistor 3 and the insulating base body 9 is small, from a viewpoint that the resistor 3 exhibits high heat resistance and from a viewpoint that the resistor 3 exhibits small specific resistance, tungsten carbide (WC) is excellent as the material of the resistor 3 among the above-mentioned materials. Further, when the insulating base body 9 is made of silicon nitride ceramics, it is preferable that the resistor 3 contains WC which is an inorganic conductive material as a main component thereof, and the content of silicon nitride to be added to WC is set to 20 mass % or more. For example, in the insulating base body 9 made of silicon nitride ceramics, a conductive component which forms the resistor 3 has a thermal expansion coefficient larger than a thermal expansion coefficient of silicon nitride and hence, the conductive component is usually in a state where a tensile stress is applied to the conductive component. To the contrary, by adding silicon nitride into the resistor 3, a thermal expansion coefficient of the resistor 3 is made to approximate a thermal expansion coefficient of the insulating base body 9 and hence, stress caused by the difference in thermal expansion coefficient between a time where a temperature of the heater 1 is elevated and a time where a temperature of the heater 1 is lowered can be alleviated.

Further, when the content of silicon nitride contained in the resistor 3 is 40 mass % or less, a resistance value of the resistor 3 can be made relatively small and stable. Accordingly, it is preferable that the content of silicon nitride contained in the resistor 3 is set to a value which falls within a range of from 20 mass % to 40 mass %. It is more preferable that the content of silicon nitride is within a range of from 25 mass % to 35 mass %. As an additive to be added into the resistor 3 in the same manner as silicon nitride, 4 mass % to 12 mass % of boron nitride may be added into the resistor 3 in place of silicon nitride.

Further, a thickness of the resistor 3 (a thickness in the vertical direction shown in FIG. 3) is preferably 0.5 mm to 1.5 mm, for example. By setting the thickness of the resistor 3 to a value which falls within this thickness range, the resistance of the resistor 3 is made small so that heat can be generated efficiently and, further, the adhesion of a lamination interface in the insulating base body 9 having the laminated structure can be held.

Further, a width of the resistor 3 (a width in the horizontal direction in FIG. 3) is preferably 0.3 mm to 1.3 mm, for example. By setting the width of the resistor 3 to a value which falls within this width range, resistance of the resistor 3 is made small so that heat can be generated efficiently and, further, the adhesion of a lamination interface in the insulating base body 9 having the laminated structure can be held.

As the leads 8 joined to the end portions of the resistor 3, it is possible to use a lead which contains carbide, nitride, silicide or the like of W, Mo, Ti or the like as a main component. For example, by allowing the lead 8 to contain a larger amount of materials for forming the insulating base body 9 than that of the resistor 3 or by setting a cross-sectional area of the lead 8 larger than a cross-sectional area of the resistor 3 or the like, a resistance value per unit length of the lead 8 can be made smaller than a resistance value per unit length of the resistor 3.

The lead 8 joined to the end portion of the resistor 3 has a resistance value per unit length which is lower than a resistance value per unit length of the resistor 3. The lead 8 can be formed using the same material as the resistor 3. Particularly, from a viewpoint that the difference in a thermal expansion coefficient between the lead 8 and the insulating base body 9 is small, from a viewpoint that the lead 8 exhibits high heat resistance and from a viewpoint that the lead 8 exhibits small specific resistance, WC is preferable as the material for forming the lead 8. Further, it is preferable that the lead 8 contains WC which is an inorganic conductive material as a main component, and silicon nitride is added into WC such that the content of silicon nitride becomes 15 mass % or more. Along with the increase of the content of silicon nitride, it is possible to make a thermal expansion coefficient of the lead 8 approximate a thermal expansion coefficient of silicon nitride for forming the insulating base body 9. Further, when the content of silicon nitride is 40 mass % or less, a resistance value of the lead 8 is made small and becomes stable. Accordingly, it is preferable that the content of silicon nitride is set to a value which falls within a range of from 15 mass % to 40 mass %. It is more preferable that the content of silicon nitride is set to a value which falls within a range of from 20 mass % to 35 mass %. In place of setting the content of a material for forming the insulating base body 9 in the lead 8 smaller than the content of the material for forming the insulating base body 9 in the resistor 3, the resistance value per unit length of the lead 8 may be set lower than the resistance value per unit length of the resistor 3 by making a cross-sectional area of the lead 8 larger than a cross-sectional area of the resistor 3.

As shown in FIG. 3, the joining portion between the resistor 3 and the leads 8 has a region where the resistor 3 is spaced apart from the insulating base body 9 by way of the leads 8 over the whole circumference of the resistor when viewed in cross section of the joining portion perpendicular to the axial direction of each of the leads 8. In other words, the joining portion has a region where the leads 8 surround the whole circumference of the resistor 3 when viewed in cross section of the joining portion perpendicular to the axial direction of each of the leads 8. In this specification, the joining portion means a region where an interface between the resistor 3 and the leads 8 exists when viewed in cross section of the joining portion parallel to the axial direction of each of the leads 8. In FIG. 2, a region where the resistor 3 is covered with the leads 3 forms the joining portion, and the interface between the resistor 3 and the leads 8 is indicated by a broken line.

Due to such a constitution, the heater 1 has the joining portion where the leads 8 surround the whole circumference of the resistor 3 and hence, an electric current which flows through the leads 8 is dispersed so that the electric current is not concentrated on one point, that is, a triple interface provided at the end portion of the joining portion and, further, the heat dissipation from the whole circumference of the resistor 3 to the leads 8 is improved uniformly, thus preventing the generation of the large stress concentration on the end portion of the joining portion between the resistor 3 and the leads 8. As a result, even when a temperature is elevated and lowered repeatedly, it is possible to suppress the generation of cracks in the end portion of the joining portion. Accordingly, the reliability and the durability of the heater 1 are enhanced.

The triple interface means a region where the interface between the resistor 3 and the leads 8, an interface between the resistor 3 and the insulating base body 9, and an interface between the leads 8 and the insulating base body 9 are brought into contact with each other.

With respect to the joining portion between the resistor 3 and the leads 8, it is preferable that a region where the resistor 3 is spaced apart from the insulating base body 9 by way of the leads 8 over the whole circumference of the resistor when viewed in cross section of the joining portion is 90% or more, and it is more preferable that, particularly in the whole region of the joining portion, the resistor 3 is spaced apart from the insulating base body 9 by way of the leads 8 over the whole circumference of the resistor when viewed in cross section of the joining portion perpendicular to the axial direction of each of the leads 8. By setting the region where the resistor 3 is spaced apart from the insulating base body 9 by way of the leads 8 over the whole circumference of the resistor in such a range, due to the reasons described above, it is possible to effectively prevent the generation of large stress concentration on the interface between the resistor 3 and the leads 8 during a cooling step in use.

Figure 4:
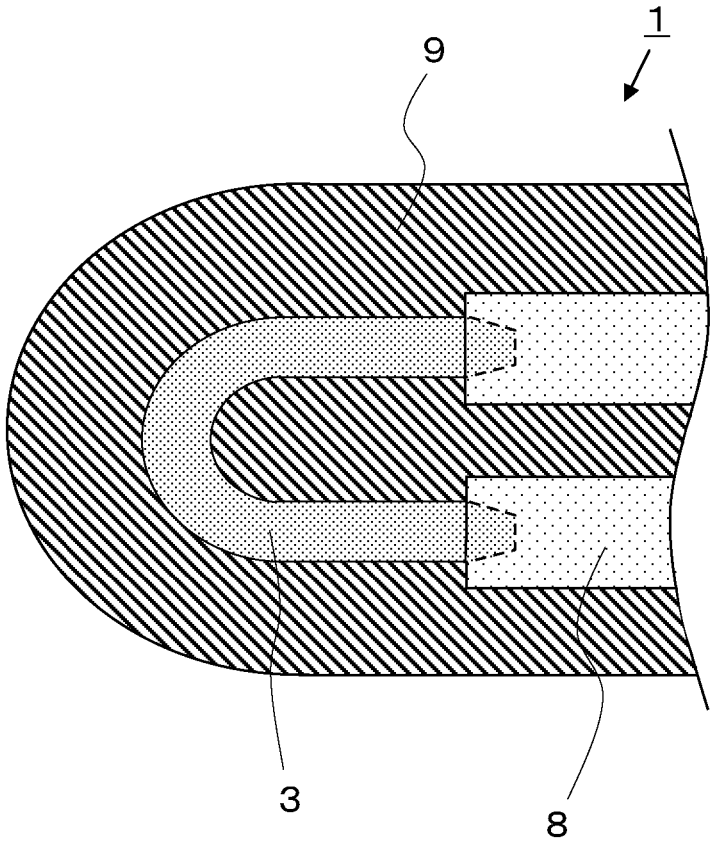
FIG. 4 is a longitudinal cross sectional view showing another example of the embodiment of the heater of the invention.

It is preferable that the heater 1 according to this embodiment be configured such that, as shown in FIG. 4, a profile of the resistor 3 in the joining portion is tapered toward a side opposite to the heat-generating portion 4. To be more specific, it is preferable that a profile of the resistor 3 in the joining portion is tapered toward a side opposite to the heat-generating portion 4 such that a cross-sectional area of the resistor 3 is decreased by 50% to 90%. Due to such a constitution, in a portion where the cross section of the heater 1 perpendicular to the axial direction of each of the leads 8 includes the joining portion, a thermal expansion coefficient can be changed in an inclined manner from a heat-generating portion 4 side to a lead 8 side, thus providing the heater constitution by which the sharp difference in thermal expansion is hardly generated.

Figure 5:
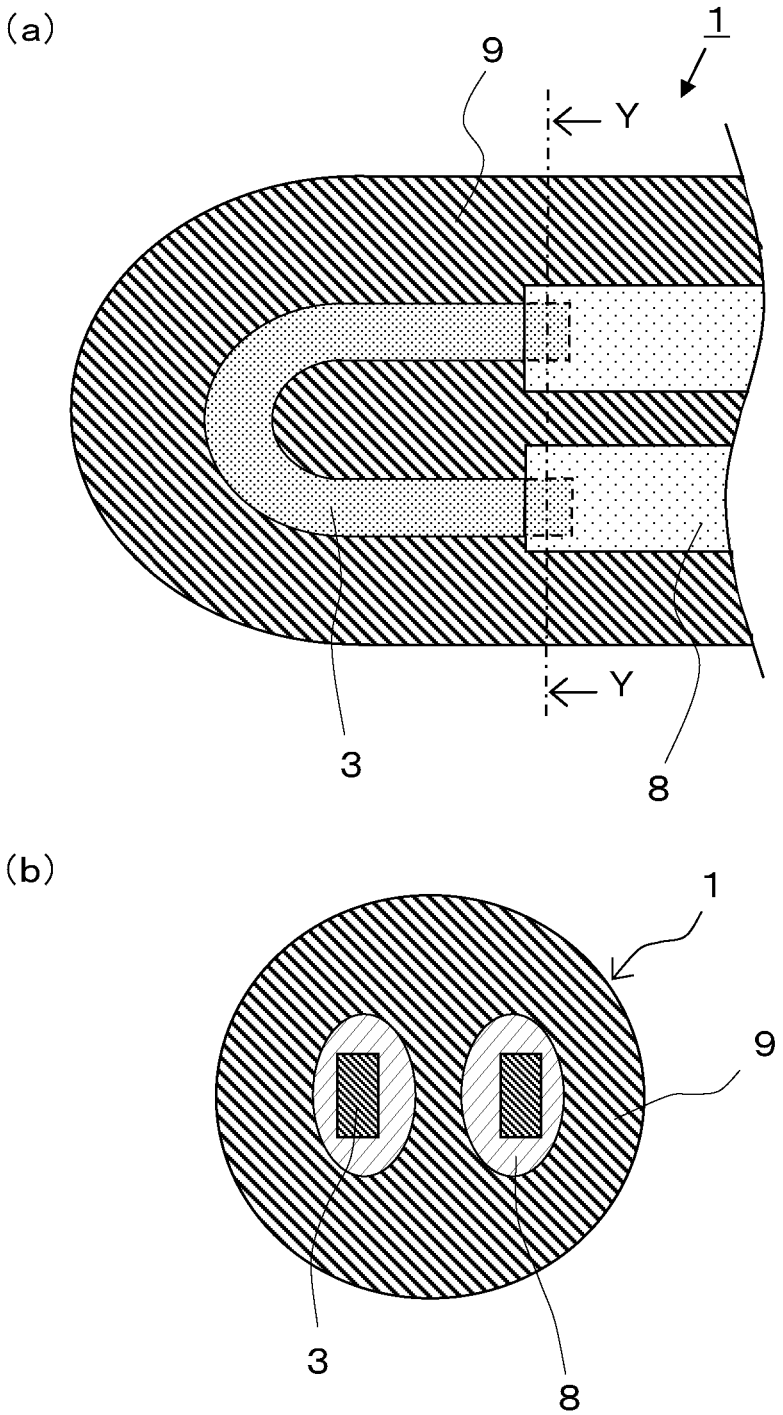
FIG. 5(*a*) is a longitudinal cross-sectional view showing another example of the embodiment of the heater according to the invention, and FIG. 5(*b*) is a transverse cross-sectional view taken along the line Y-Y in FIG. 5(*a*)

Further, in an embodiment where the resistor 3 has a folded shape and the leads 8 are joined to both end portions of the resistor 3, respectively, as shown in FIG. 5, it is preferable that the centroid of the resistor 3 is positioned outside the centroid of each of the leads 8 when the joining portion is viewed in cross section perpendicular to the axial direction of each of the leads 8. To be more specific, it is preferable that the centroid of the resistor 3 is positioned, for example, 0.03 mm to 0.2 mm outside the centroid of each of the leads 8. Due to such a constitution, a cross-sectional area of an inner side of each of the leads 8 can be increased. In general, an electric current flows through the inner side of each of the leads 8 and hence, electric current density per cross-sectional area can be decreased, thus suppressing the generation of local heating. As a result, the product resistance is not changed even when the heater is used for a long period. Accordingly, the reliability and durability of the heater 1 is further enhanced.

Figure 6:
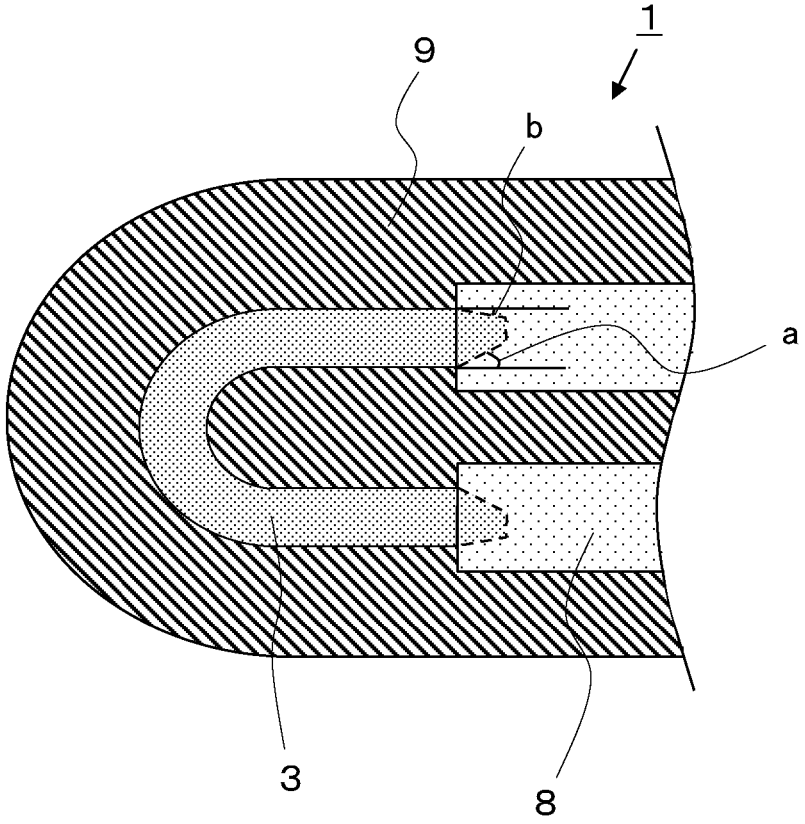
FIG. 6 is a longitudinal cross sectional view showing another example of the embodiment of the heater according to the invention.

Further, in an embodiment where the resistor 3 has a folded shape and the leads 8 are respectively joined to both end portions of the resistor 3, as shown in FIG. 6, it is preferable that an inner-side inclination angle "a" is set steeper than an outer-side inclination angle "b" when the joining portion is viewed in cross section parallel to the axial direction of each of the leads 8. To be more specific, the inner-side inclination angle "a" is preferably set steeper than the outer-side inclination angle "b" by approximately 5° to 20° (the inclination angle "a" being larger than the inclination angle "b"). Here, the inner-side inclination angle "a" is an angle made by the axial direction of each of the leads and an inner side surface of the resistor 3 in the joining portion, and the outer-side inclination angle "b" is an angle made by the axial direction of each of the leads and an outer side surface of the resistor 3 in the joining portion. Due to such a constitution, electric current density per cross-sectional area of an inner side of each of the leads 8 can be further efficiently decreased and hence, the generation of local heating can be suppressed. As a result, the product resistance is not changed even when the heater is used for a long period. Accordingly, the reliability and durability of the heater 1 can be further enhanced.

Figure 7:
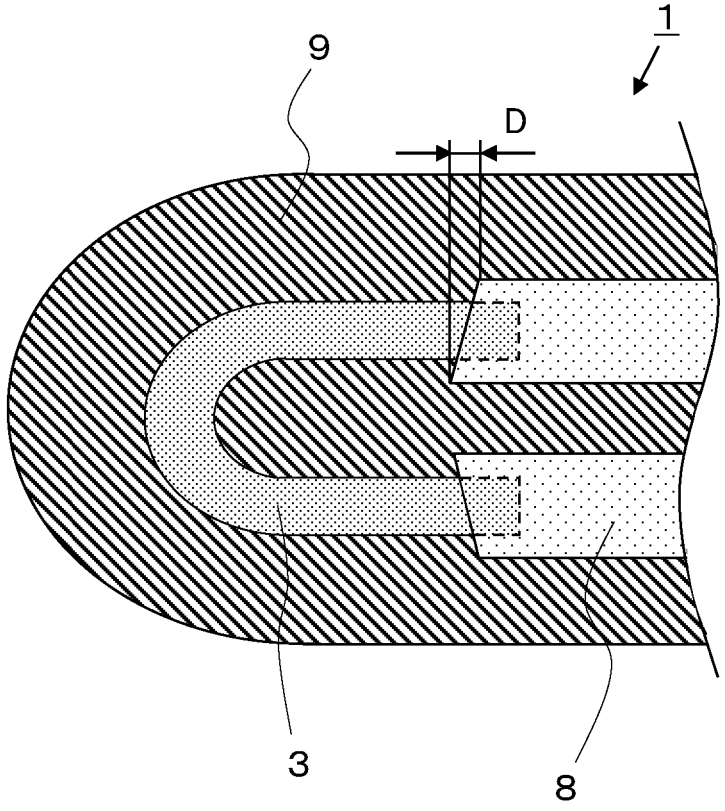
FIG. 7 is a longitudinal cross sectional view showing another example of the embodiment of the heater according to the invention.

From a viewpoint that electric current density can be decreased, it is preferable that, in an embodiment where the resistor 3 has a folded shape and the leads 8 are respectively joined to both end portions of the resistor 3, as shown in FIG. 7, a distal end surface of each of the leads 8 is inclined inwardly when the joining portion is viewed in cross section parallel to the axial direction of each of the leads 8. In other words, it is preferable that the distal end surface of each of the leads 8 is inclined such that a length of the joining portion on an inner side is set larger than a length of the joining portion on an outer side by a distance D. To be more specific, it is preferable that the distal end surface is inclined in the direction toward the inside from the outside by 0.2 mm to 0.8 mm, for example, or the length of the joining portion on the outer side be set larger than the length of the joining portion on an inner side by 0.2 mm to 0.8 mm, for example. Due to such a constitution, electric current density per cross-sectional area of the inner side of each of the leads 8 can be decreased further efficiently and hence, the generation of local heating can be suppressed. As a result, the product resistance is not changed even when the heater is used for a long period. Accordingly, the reliability and durability of the heater 1 can be further enhanced.

Figure 8:
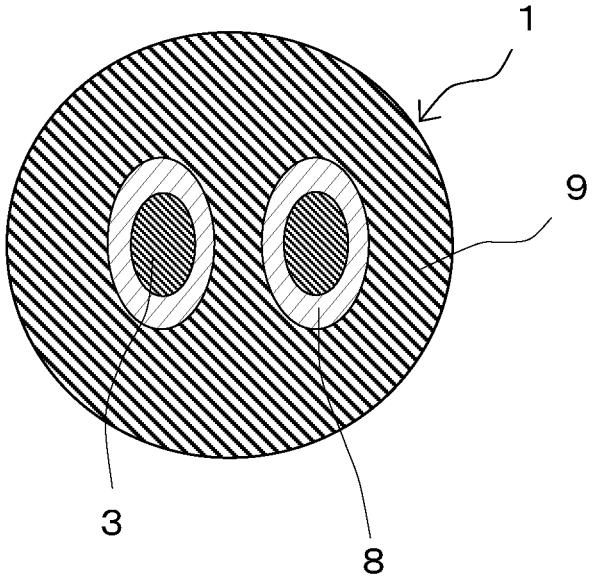
FIG. 8 is a transverse cross-sectional view showing another example of the embodiment of the heater according to the invention.

It is preferable that, as shown in FIG. 8, a profile of the resistor 3 is formed in a curve having an arcuate shape or the like when the joining portion is viewed in cross section perpendicular to the axial direction of each of the leads 8. Due to such a constitution, the generation of stress concentration on a corner portion of the resistor 3 can be prevented, thus suppressing the generation of local heating on the corner portion. As a result, the product resistance is not changed even when the heater is used for a long period. Accordingly, the reliability and durability of the heater 1 can be further enhanced.

Figure 9:
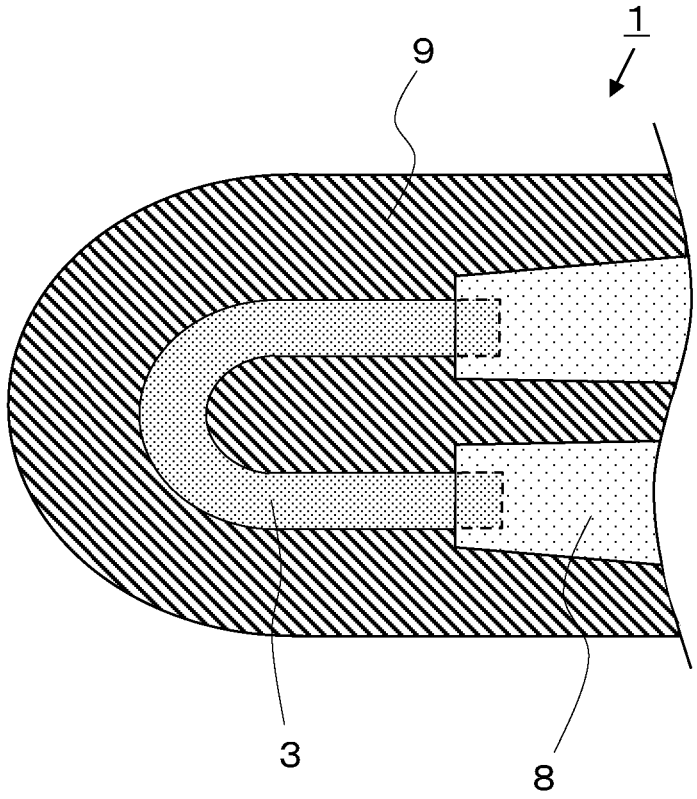
FIG. 9 is a longitudinal cross sectional view showing another example of the embodiment of the heater according to the invention.

It is preferable that, as shown in FIG. 9, a profile of each of the leads 8 in the joining portion is tapered toward a heat-generating portion 4 side. Due to such a constitution, the shape of the joining portion can be continuously changed and hence, maximum principal stress generated during a cooling step at the time of using the heater 1 can be made small thus suppressing the generation of local heating. As a result, the product resistance is not changed even when the heater is used for a long period. Accordingly, the reliability and durability of the heater 1 can be further enhanced.

It is preferable that the heater 1 according to this embodiment is used for a glow plug, the glow plug including the heater 1 according to any one of the constitutions mentioned above, a sheath fitting electrically connected to one lead 8, and a wire electrically connected to another lead 8. The sheath fitting is a metal-made cylindrical body for holding the heater 1, and is joined to one lead 8 which is pulled out to a side surface of the ceramic base body 9 using a brazing material or the like. On the other hand, the wire is joined to the other lead 8 which is pulled out to a rear end of the other ceramic base body 9 using a brazing material or the like. Due to such a constitution, even when the glow plug is used in en engine at a high temperature for a long period in a state where ON/OFF operations of the glow plug are repeated, the resistance of the heater 1 is not changed and hence, it is possible to provide the glow plug which exhibits excellent ignitability at any time.

Next, a method of manufacturing the heater 1 according to this embodiment is explained.

The heater 1 according to this embodiment is formed by injection molding or the like which uses molds having shapes of the resistor 3, the leads 8 and the insulating base body 9, respectively.

Firstly, a conductive paste which contains conductive ceramic powder, a resin binder and the like and is used for forming the resistor 3 and the leads 8 is prepared, and also a ceramic paste which contains insulating ceramic powder, a resin binder and the like and is used for forming the insulating base body 9 is prepared.

Next, a formed body formed of a conductive paste having a predetermined pattern for forming the resistor 3 (formed body A) is formed by injection molding or the like using the conductive paste. In a state where the formed body A is held in the inside of a mold, the conductive paste is filled into the inside of the mold thus forming a formed body formed of a conductive paste having a predetermined pattern for forming the leads 8 (formed body B). Accordingly, the formed body A and the formed body B which is connected to the formed body A are brought into a state where the formed bodies A, B are held in the mold.

Next, in a state where the formed body A and the formed body B are held in the mold, a portion of the mold is exchanged with a mold for molding the insulating base body 9, and a ceramic paste for forming the insulating base body 9 is filled into the mold. Due to such steps, a formed body of the heater 1 (formed body E) where the formed body A and the formed body B are covered with a formed body formed of the ceramic paste (formed body C) is obtained.

Next, by baking the obtained formed body E at a temperature of approximately 1700° C., the heater 1 can be manufactured. It is preferable to perform baking in a non-oxidizing gas atmosphere such as a hydrogen gas.

EXAMPLES

The heater according to an example of the invention was prepared as follows.

Firstly, a formed body A for forming the resistor was prepared by molding a conductive paste containing 50 mass % of tungsten carbide (WC) powder, 35 mass % of silicon nitride ($Si_3N_4$) powder and 15 mass % of resin binder in a mold by injection molding.

Next, in a state where the formed body A was held in the inside of the mold, the above-mentioned conductive paste for forming the leads was filled into the mold thus forming a formed body B for forming the leads by connecting the formed body B to the formed body A. Here, as described with respect to Samples No. 1 to No. 13 shown in Table 1, joining portions each of which is constituted of a resistor and leads having 13 kinds of shapes were formed using molds having various shapes.

In Table 1, Sample No. 1 is a heater where the joining portion between the resistor and the leads does not have a region where the resistor is spaced apart from the insulating base body by way of the leads over the whole circumference of the resistor when viewed in cross section of the joining portion, and an interface between the resistor and the leads is inclined when viewed in cross section parallel to the axial direction of each of the leads. Further, in Table 1, a heat-generating portion cross-sectional area of the resistor is an area of transverse cross section of the resistor in the heat-generating portion, and a joining portion (end portion) cross-sectional area of the resistor is an area of an end portion of the resistor. The position of the centroid of the resistor with respect to the centroid of each of the leads indicates the positional relationship between the centroid of the resistor and the centroid of each of the leads as viewed in transverse cross section at the position corresponding to the distal end of each of the leads. A joining-portion axial length D (inner side—outer side) is a value obtained by subtracting an outer-side length of the joining portion (region where the resistor and the leads overlap with each other) in the axial direction from an inner-side length of the joining portion in the axial direction. A shape of the joining portion of each of the leads (the shape extending toward a heat-generating portion side) is set such that a profile of a transverse cross section of each of the leads in the joining portion maintains the same shape or is tapered toward a heat-generating portion side.

Next, in a state where the formed body A and the formed body B were held in the mold, a ceramic paste containing 85 mass % of silicon nitride ($Si_3N_4$) powder, 10 mass % of oxide ($Yb_2O_3$) of ytterbium (Yb) which constitutes a sintering aid, and 5 mass % of WC for making a thermal expansion rate of the insulating base body approximate a thermal expansion coefficient of the resistor and a thermal expansion coefficient of each of the leads was filled into a mold by injection molding. Due to such a step, a formed body E where the formed body A and the formed body B were embedded in the formed body C which constitutes the insulating base body was formed.

Next, the obtained formed body E was put into a cylindrical mold made of carbon and, thereafter, the formed body E was sintered by hot-pressing in a non-oxidizing gas atmosphere made of a nitrogen gas at a temperature of 1650° C. to 1780° C. and under a pressure of 30 MPa to 50 MPa. A sheath fitting was joined to an end portion of the lead exposed to a surface of the obtained sintered body by blazing thus manufacturing a heater.

A thermal cycle test was performed using this heater. As conditions of the thermal cycle test, firstly, the heater was energized and an applied voltage was set such that a temperature of the resistor becomes 1400° C., and the thermal cycle test was repeated 10,000 cycles with 1 cycle being constituted of (1) energization for 5 minutes and (2) non-energization for 2 minutes. A change in a resistance value of the heater before and after the thermal cycle test was measured. It was determined that there was no problem in durability when the change in the resistance value was less than 10%, (expressed by "Good" in Table 1), and there was a problem in durability when the change in the resistance value was 10% or more (expressed by "Bad" in Table 1). A result of the thermal cycle test is shown in Table 1.

Micro cracks were generated in the joining portion between the resistor and the leads with respect to the Samples which were determined to have a problem in durability.

TABLE 1

| Sample No. | Heat-generating portion cross-sectional area of Resistor ($mm^2$) | Joining portion (end portion) cross-sectional area of Resistor ($mm^2$) | Joining portion cross-sectional area of Resistor/ Heat-generating portion cross-sectional area of Resistor (%) | Position of centroid of Resistor with respect to centroid of Lead +: Outer side, −: Inner side (mm) | Inclination angle b of Resistor (Outer side) (°) | Inclination angle a of Resistor (Inner side) (°) |
|---|---|---|---|---|---|---|
| *1 | 0.60 | — | — | — | — | — |
| 2 | 0.60 | 0.60 | 100 | ±0 | 0 | 0 |
| 3 | 0.60 | 0.55 | 92 | +0.05 | 15 | 20 |
| 4 | 0.60 | 0.45 | 75 | +0.05 | 10 | 20 |
| 5 | 0.60 | 0.45 | 75 | +0.05 | 10 | 20 |
| 6 | 0.60 | 0.40 | 67 | +0.05 | 10 | 25 |
| 7 | 0.60 | 0.20 | 33 | +0.05 | 10 | 30 |
| 8 | 0.60 | 0.45 | 75 | −0.05 | 10 | 20 |
| 9 | 0.60 | 0.45 | 75 | ±0 | 10 | 20 |
| 10 | 0.60 | 0.45 | 75 | +0.2 | 15 | 15 |
| 11 | 0.60 | 0.45 | 75 | +0.05 | 10 | 20 |
| 12 | 0.60 | 0.45 | 75 | +0.05 | 10 | 20 |
| 13 | 0.60 | 0.45 | 75 | +0.05 | 10 | 20 |

TABLE 1-continued

| Sample No. | Joining-portion axial length D (Inner side) − (Outer side) (mm) | Cross-sectional shape of joining portion of Resistor | Shape of joining portion of Lead (Shape extending toward heat-generating portion side) | Durability Change in resistance (%) | Durability Determination |
|---|---|---|---|---|---|
| *1 | — | — | — | 55 | Bad |
| 2 | 0.3 | Elliptical shape | Tapered | 7 | Good |
| 3 | 0.3 | Elliptical shape | Tapered | 1 | Good |
| 4 | 0.3 | Elliptical shape | Tapered | 0 | Good |
| 5 | 0.3 | Elliptical shape | Same | 2 | Good |
| 6 | 0.3 | Quadrangular shape | Tapered | 2 | Good |
| 7 | 0.3 | Elliptical shape | Tapered | 1 | Good |
| 8 | 0.3 | Elliptical shape | Tapered | 6 | Good |
| 9 | 0.3 | Elliptical shape | Tapered | 5 | Good |
| 10 | 0.3 | Elliptical shape | Tapered | 5 | Good |
| 11 | −0.3 | Elliptical shape | Tapered | 4 | Good |
| 12 | 0 | Elliptical shape | Tapered | 3 | Good |
| 13 | 0.1 | Elliptical shape | Tapered | 1 | Good |

Asterisk (*) indicates sample out of scope of the invention

As can be understood from Table 1, Samples No. 3, No. 4, No. 7 and No. 13 which fall within the scope of the invention are heaters where the joining portion between the resistor and the leads has a region where the resistor is spaced apart from the insulating base body by way of the leads over the whole circumference of the resistor when viewed in cross section of the joining portion, a profile of the resistor is tapered toward a side opposite to the heat-generating portion, the centroid of the resistor is positioned outside the centroid of each of the leads, an inner-side inclination angle is set steeper than an outer-side inclination angle, a distal end surface of each of the leads is inclined inwardly, the profile of the resistor is formed in a curve, and a profile of each of the leads is tapered toward a heat-generating portion side. Among the heaters of the invention, the above-mentioned heaters of Samples No. 3, No. 4, No. 7 and No. 13 exhibited the smallest change in resistance of 1% or less.

Sample No. 5 which falls within the scope of the invention is a heater where the joining portion between the resistor and the leads has a region where the resistor is spaced apart from the insulating base body by way of the leads over the whole circumference of the resistor when viewed in cross section of the joining portion, a profile of the resistor is tapered toward a side opposite to the heat-generating portion, the centroid of the resistor is positioned outside the centroid of each of the leads, an inner-side inclination angle is set steeper than an outer-side inclination angle, a distal end surface of each of the leads is inclined inwardly, and the profile of the resistor is formed in a curve. The heater of Sample No. 5 exhibited a change in resistance of 2%.

Sample No. 6 which falls within the scope of the invention is a heater where the joining portion between the resistor and the leads has a region where the resistor is spaced apart from the insulating base body by way of the leads over the whole circumference of the resistor when viewed in cross section of the joining portion, a profile of the resistor is tapered toward a side opposite to the heat-generating portion, the centroid of the resistor is positioned outside the centroid of each of the leads, an inner-side inclination angle is set steeper than an outer-side inclination angle, a distal end surface of each of the leads is inclined inwardly, and the profile of each of the leads is tapered toward a heat-generating portion side. The heater of Sample No. 6 exhibited a change in resistance of 2%.

Sample No. 2 which falls within the scope of the invention is a heater where the joining portion between the resistor and the leads has a region where the resistor is spaced apart from the insulating base body by way of the leads over the whole circumference of the resistor when viewed in cross section of the joining portion, a distal end surface of each of the leads is inclined inwardly, a profile of the resistor is formed in a curve, and a profile of each of the leads is tapered toward a heat-generating portion side. Among the heaters of the invention, the above-mentioned heater of Sample No. 2 exhibited the largest change in resistance of 7%.

Samples No. 8 and No. 9 which fall within the scope of the invention are heaters where the joining portion between the resistor and the leads has a region where the resistor is spaced apart from the insulating base body by way of the leads over the whole circumference of the resistor when viewed in cross section of the joining portion, a profile of the resistor is tapered toward a side opposite to the heat-generating portion, an inner-side inclination angle is set steeper than an outer-side inclination angle, a distal end surface of each of the leads is inclined inwardly, a profile of the resistor is formed in a curve, and a profile of each of the leads is tapered toward a heat-generating portion side. Among the heaters of the invention, the above-mentioned heaters of Samples No. 8 and No. 9 exhibited relatively large changes in resistance of 6% and 5%, respectively.

Sample No. 10 which falls within the scope of the invention is a heater where the joining portion between the resistor and the leads has a region where the resistor is spaced apart from the insulating base body by way of the leads over the whole circumference of the resistor when viewed in cross section of the joining portion, a profile of the resistor is tapered toward a side opposite to the heat-generating portion, the centroid of the resistor is positioned outside the centroid of each of the leads, a distal end surface of each of the leads is inclined inwardly, a profile of the resistor is formed in a curve, and a profile of each of the leads is tapered toward a heat-generating portion side. The heater of Sample No. 10 exhibited a change in resistance of 5%.

Samples No. 11 and No. 12 which fall within the scope of the invention are heaters where the joining portion between the resistor and the leads has a region where the resistor is spaced apart from the insulating base body by way of the leads over the whole circumference of the resistor when viewed in cross section of the joining portion, a profile of the resistor is tapered toward a side opposite to the heat-generating portion, the centroid of the resistor is positioned outside the centroid of each of the leads, an inner-side inclination angle is set steeper than an outer-side inclination angle, a profile of the resistor is formed in a curve, and a profile of each of the leads is tapered toward a heat-generating portion side. The heaters of Samples No. 11 and No. 12 exhibited changes in resistance of 4% and 3%, respectively.

The heater of Sample No. 1 which falls out of the scope of the invention exhibits an extremely large change in resistance of 55%.

REFERENCE SIGNS LIST

1: Heater
2: Distal end portion
3: Resistor
4: Heat-generating portion
8: Leads
9: Insulating base body

What is claimed is:

1. A heater comprising:
a resistor comprising a heat-generating portion configured to heat a glow plug;
one or more leads joined to end portions of the resistor; and
an insulating base body which covers the resistor and the leads, wherein
an end surface of the resistor is covered with one of the leads over a whole circumference in a circumferential direction of the resistor,
the end surface of the resistor is spaced apart from the insulating base body by way of the one of the leads, wherein
the resistor has a folded shape,
the leads are joined to each of the end portions of the resistor at a corresponding joining portion, and
an inner-side inclination angle of the resistor is set steeper than an outer-side inclination angle of the resistor when the joining portion is viewed in cross section parallel to the axial direction of each of the leads.

2. The heater according to claim 1, wherein
a profile of the resistor in the joining portion is tapered toward a side opposite to the heat-generating portion.

3. The heater according to claim 1, wherein
when each corresponding joining portion is viewed in cross section perpendicular to an axial direction of each of the leads:
each end portion of the resistor comprises a resistor centroid,
each lead comprises a lead centroid, and
for at least one corresponding joining portion, the resistor centroid is displaced from the lead centroid.

4. The heater according to claim 1, wherein
a profile of the resistor is formed in a curve when the joining portion is viewed in cross section perpendicular to the axial direction of each of the leads.

5. A heater comprising:
a resistor comprising a heat-generating portion configured to heat a glow plug;
one or more leads joined to end portions of the resistor; and
an insulating base body which covers the resistor and the leads, wherein
an end surface of the resistor is covered with one of the leads over a whole circumference in a circumferential direction of the resistor,
the end surface of the resistor is spaced apart from the insulating base body by way of the one of the leads, wherein
the resistor has a folded shape,
the leads are joined to each of the end portions of the resistor at a corresponding joining portion, and
a distal end surface of each of the leads is inclined inwardly when the joining portion is viewed in cross section parallel to the axial direction of each of the leads.

6. The heater according to claim 5, wherein
a profile of the resistor in the joining portion is tapered toward a side opposite to the heat-generating portion.

7. The heater according to claim 5, wherein
when each corresponding joining portion is viewed in cross section perpendicular to an axial direction of each of the leads:
each end portion of the resistor comprises a resistor centroid,
each lead comprises a lead centroid, and
for at least one corresponding joining portion, the resistor centroid is displaced from the lead centroid.

8. The heater according to claim 5, wherein
a profile of the resistor is formed in a curve when the joining portion is viewed in cross section perpendicular to the axial direction of each of the leads.

9. A heater comprising:
a resistor comprising a heat-generating portion configured to heat a glow plug;
one or more leads joined to end portions of the resistor; and
an insulating base body which covers the resistor and the leads, wherein
an end surface of the resistor is covered with one of the leads over a whole circumference in a circumferential direction of the resistor,
the end surface of the resistor is spaced apart from the insulating base body by way of the one of the leads,
the leads are joined to each of the end portions of the resistor at a corresponding joining portion, and
a profile of each of the leads in the joining portion is tapered toward a heat-generating portion side.

10. The heater according to claim 9, wherein
a profile of the resistor in the joining portion is tapered toward a side opposite to the heat-generating portion.

11. The heater according to claim 9, wherein
the resistor has a folded shape, and
when each corresponding joining portion is viewed in cross section perpendicular to an axial direction of each of the leads:
each end portion of the resistor comprises a resistor centroid,
each lead comprises a lead centroid, and
for at least one corresponding joining portion, the resistor centroid is displaced from the lead centroid.

12. The heater according to claim 9, wherein
a profile of the resistor is formed in a curve when the joining portion is viewed in cross section perpendicular to the axial direction of each of the leads.

* * * * *